United States Patent [19]

Mahnke

[11] Patent Number: 4,678,185

[45] Date of Patent: Jul. 7, 1987

[54] EXERCISE APPARATUS

[75] Inventor: Parker E. Mahnke, Studio City, Calif.

[73] Assignee: Marcy Gymnasium Equipment Co., Alhambra, Calif.

[21] Appl. No.: 820,538

[22] Filed: Jan. 17, 1986

[51] Int. Cl.[4] ..... A63B 21/00

[52] U.S. Cl. ..... 272/134; 272/118; 272/DIG. 4

[58] Field of Search ..... 272/117, 118, 123, 130, 272/134, 136, 142, 143, 144, DIG. 4

[56] References Cited

U.S. PATENT DOCUMENTS

| | | | |
|---|---|---|---|
| 3,103,357 | 9/1963 | Berne | 272/134 X |
| 4,183,520 | 1/1980 | Chase | 272/134 X |
| 4,358,108 | 11/1982 | Voris | 272/134 X |
| 4,466,613 | 8/1984 | Reese | 272/142 |

*Primary Examiner*—Richard J. Apley
*Assistant Examiner*—Robert W. Bahr
*Attorney, Agent, or Firm*—James E. Brunton

[57] ABSTRACT

A bench type exercise device which can be readily adjusted into several different starting positions to permit the performance of a wide variety of body exercises in a sitting position, a prone position, and a reclined position. The device is provided at the outboard end with a body engaging subassembly which, in a lowered position, can be used for various leg exercises such as leg extensions and which, in a raised position can be used for the performance of various arm exercises such as arm curls. The device further embodies remotely located weight stack, or other resistance providing mechanism, which is uniquely interconnected with the body engaging subassembly by means of an adjustable linkage assembly to provide a constant, uniform and predeterminable resistance to pivotal movement of the body engaging elements whether the elements are disposed in a lowered or elevated position and whether the device is being used for the performance of leg exercises or arm exercises.

15 Claims, 15 Drawing Figures

24
72
74
76
82
104
106
72
74
A
B
92
108
76
74
70a
84
70
24
64
66
68
32
36
33
26
22
30
12
16
14
16a
98
100
102
56
65
94
54
42a
44
46
42
64
58
48
65
60
42b
18
20

EXERCISE APPARATUS

BACKGROUND OF THE INVENTION

1. Field of the Invention

The present invention relates generally to body exercise devices. More particularly the invention concerns a bench type exercising apparatus for use in the performance of arm and leg exercises having pivotally movable, multi-positionable body engaging elements which are operably associated with a weight stack disposed proximate one end of the bench. A novel linkage arrangement interconnects the body engaging elements with one or more of the weights in a manner to uniformly and reproducably resist pivotal movement of the body engaging elements regardless of the position of the body engaging elements relative to the bench.

2. Discussion of the Prior Art

Various types of exercise benches have been suggested in the past. Generally the benches are provided at one end with pivotally moveable body engaging elements engageable by the feet, legs and hands of the trainee in the performance of several types of arm and leg exercises.

Resistance to pivotal movement of the body engaging elements has been provided in various ways in the prior art designs. In some devices resistance has been provided through the use of springs or elastic members. In other devices the resistance has been provided by weights interconnected with the body engaging elements by means of pulley systems or other types of mechanical interconnection. A basic problem with all the prior art devices have multi-positionable body engaging elements resides in the inability to provide a constant, predeterminable degree of resistance to the pivotal movement of the body engaging elements during the performance of the various arm and leg exercises. The present invention is directed to the solution of this troublesome problem.

SUMMARY OF THE INVENTION

It is an object of the present invention to provide a bench type exercise device which can be readily adjusted into several different starting positions to permit the performance of a wide variety of body exercises in a sitting position, a prone position, and a reclined position.

More particularly there is provided at the outboard end of the exercise bench a novel body engaging subassembly which, in a lowered position, can be used for various leg exercises such as leg extensions and which, in a raised position can be used for the peformance of various arm exercises such as arm curls.

It is another object of the invention to provide an apparatus of the aforementioned character which embodies a remotely located weight stack, or other resistance means, which is uniquely interconnected with the body engaging subassembly to provide a constant, a uniform and predeterminable resistance to pivotal movement of the body engaging elements whether the elements are disposed in a lowered or elevated position and whether the device is being used for the performance of leg exercises or arm exercises.

Still another object of the invention is to provide a device of the type described in the preceding paragraphs which includes a novel, easy to operate quick locking and release mechanism for adjusting both the starting height and arcuate position of the body engaging elements relative to the bench.

Yet another object of the invention is to provide a novel and versatile apparatus which is highly safe and reliable, embodies a minimum number of component parts, is easily adjustable without the use of special tools and is smoother, safer and more positive in operation than similar prior art machines.

The superior engineering design and compactness of the machine of the present invention permits it to be inexpensively manufactured, easily set up and operated in numerous locations, and to be safely used even by unskilled persons in a minimum of training.

DESCRIPTION OF THE INVENTION

Figure 1:
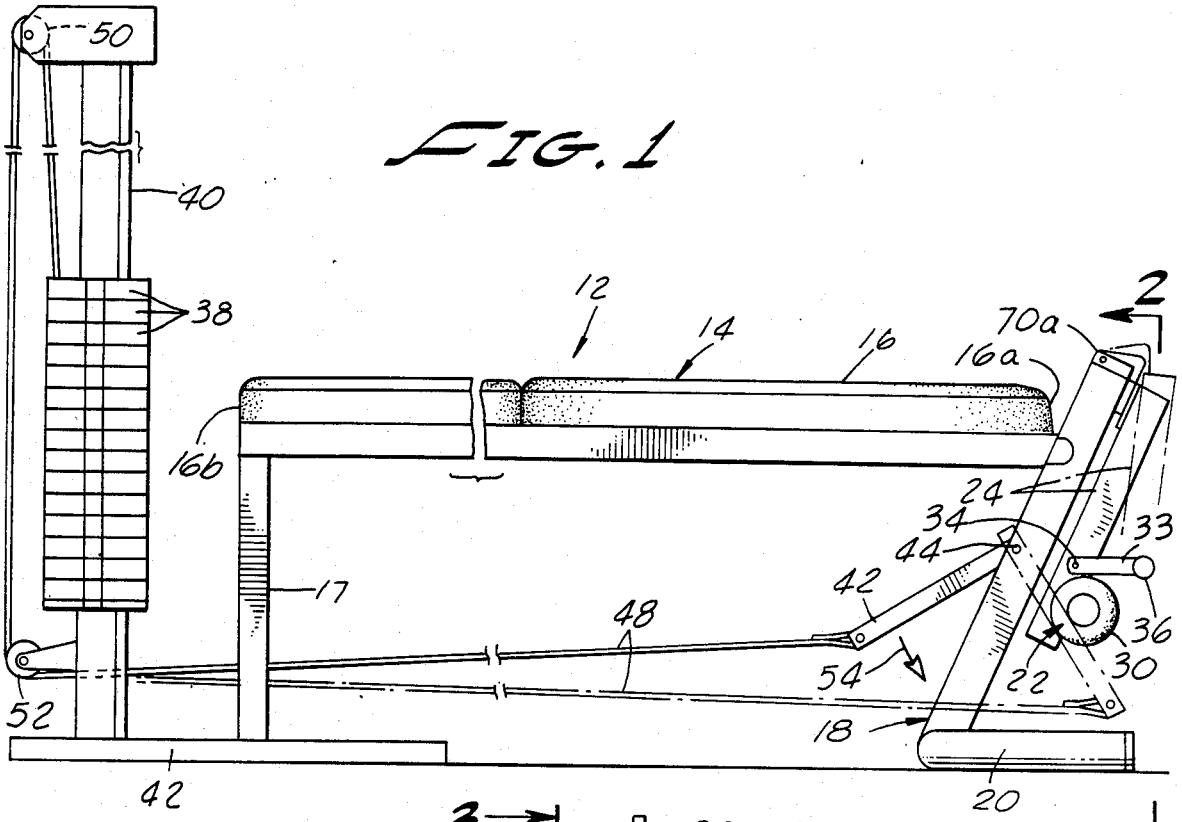
FIG. 1 is a side elevational view of one form of the exercise apparatus of the present invention.
Figure 2:
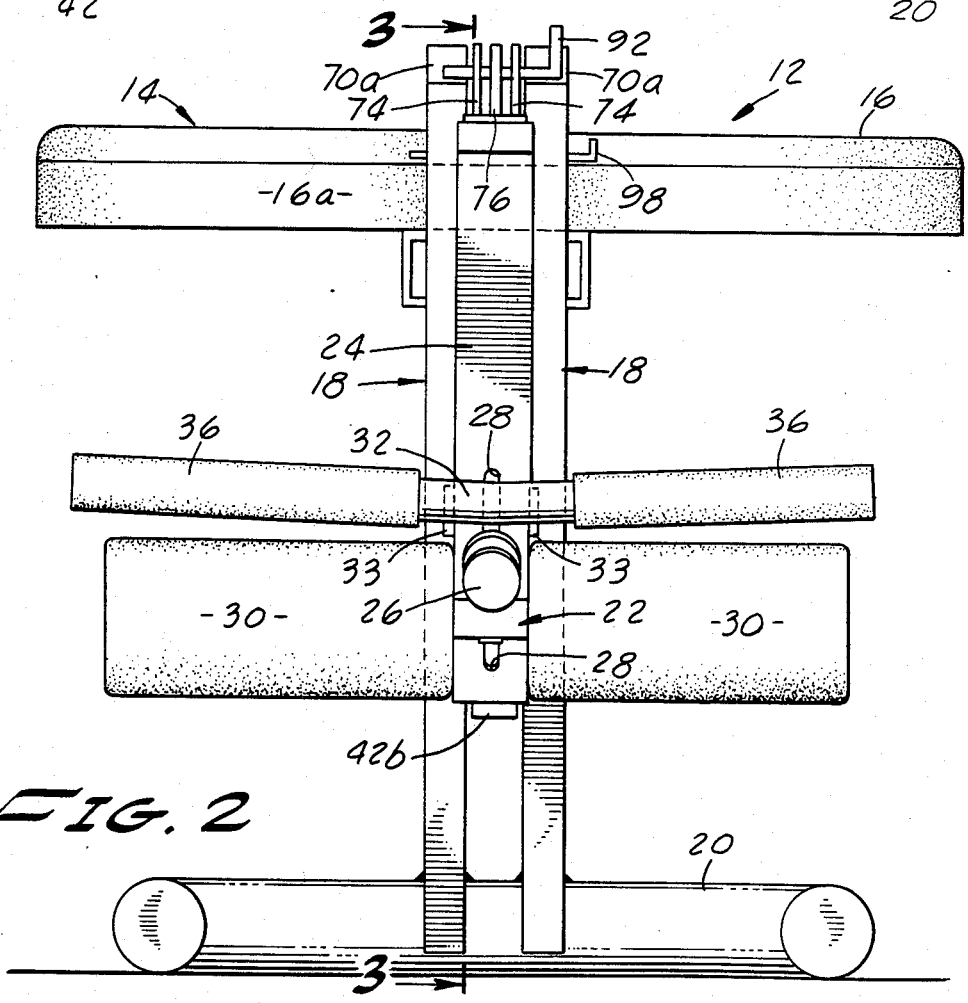
FIG. 2 is an enlarged end view of the apparatus taken along lines 2—2 of FIG. 1.
Figure 3:
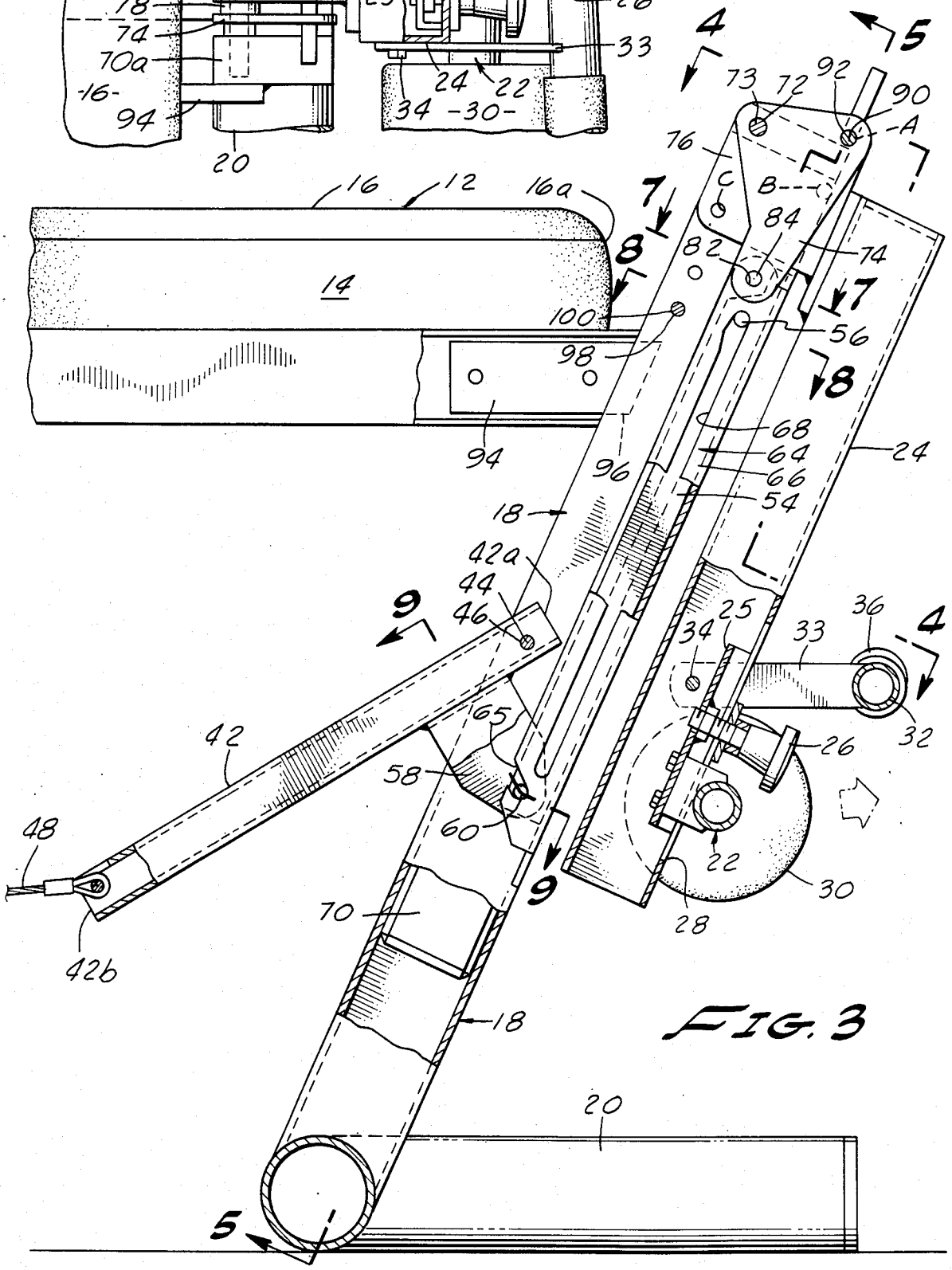
FIG. 3 is an enlarged fragmentary side view partially in section taken along lines 3—3 of FIG. 2.

Referring to the drawings and particularly to FIGS. 1 through 3, the exercise apparatus of the present invention, generally designated by the numeral 12, comprises support means for supporting the trainee in various exercising positions, first and second body engaging means disposed proximate the support means for engagement by the trainee and linkage means for operably interconnecting the body engaging means with a remotely located resistance means.

In the form of the invention shown in the drawings, the support means comprises an elevated exercise bench 14, including a trainee support surface 16 having front and rear extremities, 16*a* and 16*b* respectively. Provided proximate the front extremity of the trainee support surface are laterally spaced apart downwardly depending front leg members, or standards, 18. Members 18 are interconnected with a generally U-shaped, floor engaging base member 20. The rearward extremity of the bench is supported by rear legs 17. However, it is to noted that the rearward extremity of the bench can also be supported in an elevated position by another exercise apparatus or support means embodying resistance means.

As best seen in FIGS. 1 and 2, the body engaging means of the present invention comprise a first laterally extending body engaging member 22, which is adjustably interconnected with a rigid structural member 24 by means of a threaded knob like connector element 26 (FIG. 3) which is threadably connected to a plate 25 which forms a part of the first body engaging member 22. Structural member 24 is slotted at 30 so that by loosening knob 26 body engaging member 22 can be adjusted longitudinally of structural member 24. Provided at each side of body engaging member 22 are cylindrically shaped, soft foam pads 30 (FIG. 2). Also comprising a part of the body engaging means is a transversely extending second body engaging member 32, including a yoke-like connector 33, which is pivotally connected to the sides of structural element 24 by means of fasteners 34. Second body engaging member 32 is also provided with cylindrically shaped, foam rubber pads 36. As will be discussed in greater detail hereinafter, first body engaging member 22 is normally used in the performance of leg exercises, while second body engaging member 36 is used in the performance of arm exercises such as arm curls.

Disposed proximate the rear extremity 16*b* of the trainee support surface is resistance means which is operably associated with the body engaging means for providing a constant resistive force to resist pivotal of the body engaging means during the performance of exercises by the trainee. In the present embodiment of the invention, the resistance means is provided in the form of a plurality of stacked weights 38 one or more of which are vertically movable along a vertically disposed guide column 40 fixedly interconnected with a rigid base 42. It is to be understood that the resistance means could also take the form of springs, elastic members, magnetic devices, or other resistance mechanisms.

Figure 5:
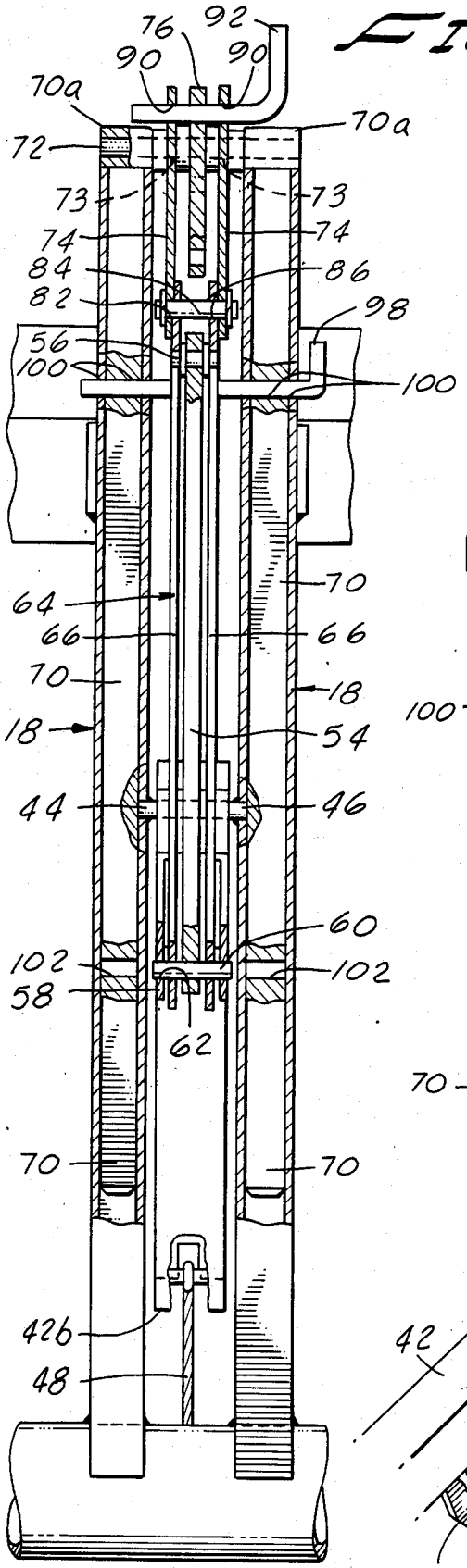
FIG. 5 is a cross sectional view taken along lines 5—5 of FIG. 4 showing the construction and method of interconnection of the linkage means of the invention.
Figure 6:
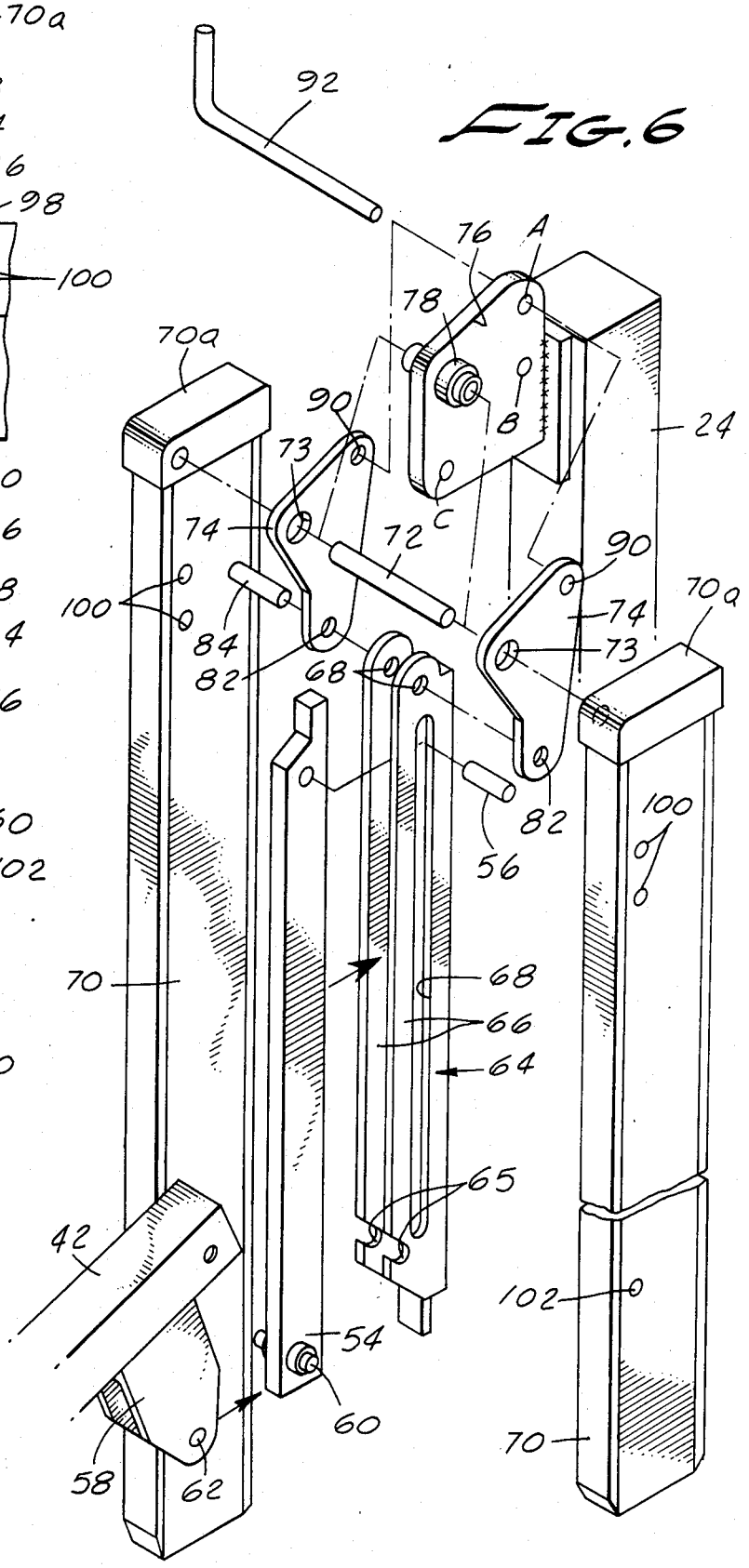
FIG. 6 is a diagramatic, exploded perspective view of the forward end of apparatus showing in greater detail the construction of the body engaging and linkage means of the invention.
Figure 7:
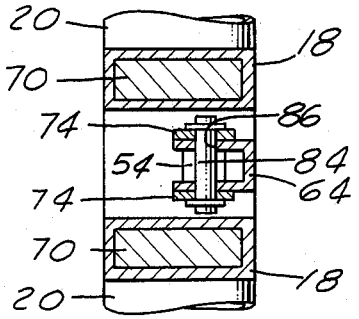
FIG. 7 is a fragmentary cross sectional view taken along lines 7—7 of FIG. 3.
Figure 9:
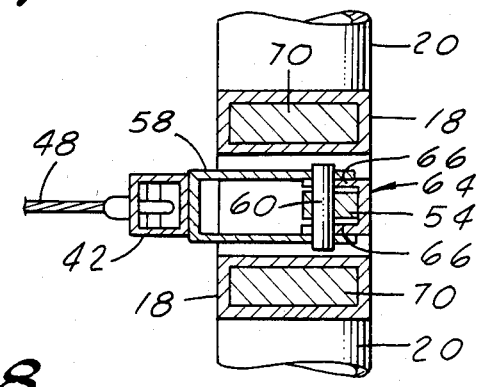
FIG. 9 is a fragmentary cross sectional view taken along lines 9—9 of FIG. 3.
Figure 8:
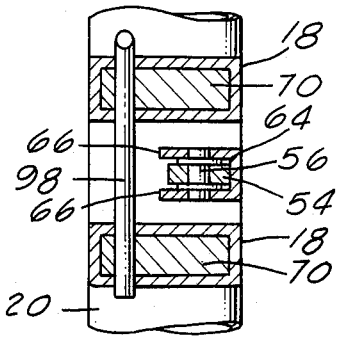
FIG. 8 is a fragmentary cross sectional view taken along lines 8—8 of FIG. 3.

Forming an extremely important feature of the present invention is the linkage means which operably interconnects the resistance means with the multi-positionable body engaging means. As best seen in FIGS. 3, 5 and 6, this linkage means comprises a first linkage 42 adapted for a pivotal movement about a fixed axis 44 which is located a fixed distance from the support means (FIG. 3). Fixed axis 44 is here defined by a transverse axle 46 which is connected to and extends between leg members 18 (FIG. 5). First linkage 42 is pivotally connected to axle 46 proximate a first end 42*a* of the linkage (FIG. 3). Connected proximate the opposite end 42*b* of first linkage 42 is an elongated, flexible cable connector 48. As shown in FIG. 1, the opposite end of cable 48, is interconnected with weight stack 38 by means of a pulley system comprising upper and lower pulleys, 50 and 52 respectively, which are rotatably carried by guide column 40. With this arrangement when first linkage member 42 is pivotally moved in a forwardly direction as indicated by arrow 54 in FIG. 1, one or more of the weights 38 will be urged upwardly along guide column 40 by means of cable 48 which is entrained around pulleys 50 and 52. Selective interconnection of the weights with the cable can be accomplished using a connector bar or other mechanism of a character well known to the designers of exercise machines. In a manner presently to be described, uniform forward pivotal movement of first linkage 42 occurs as a result of upward pivotal movement of the body engaging means regardless of the starting height of angular starting position of the body engaging means.

Referring particularly to FIGS. 3, 5, and 6, the second automatically adjustable linkage for operably interconnecting the body engaging means with the first linkage 42 comprises an elongated rigid first member 54 which is pivotally connected proximate one end to first linkage 42 of the linkage means. Provided proximate the other end of member 54 is a laterally extending is a transverse guide element 56, the purpose of which will presently be described. It is to be noted that linkage member 42 is provided intermediate its ends with a yoke like connector 58 which is interconnected with member 54 by means of a transversely extending axle 60. As indicated in FIGS. 5 and 6, axle 60 is receivable within apertures 62 provided in yoke like member 58.

Also forming a part of the second automatically adjustable linkage of the present form of the invention is a rigid elongated second member 64 having spaced apart slotted side walls 66. Elongated slots 68, which are formed in each of the side members 66 are aligned and are adapted to closely receive the previously mentioned guide element 56, which element is carried by first member 54 proximate its upper extremity. With this arrangement member 64 can be slidably moved upwardly with respect to member 54 with the side walls thereof forming a guide channel and with guide element 56 being guidable constrained within the slots 68 formed in each of the side walls of guide member 64. The purpose of this important sliding interrelationship between members 54 and 64 of the second linkage will now be described.

Figures 11, 12:
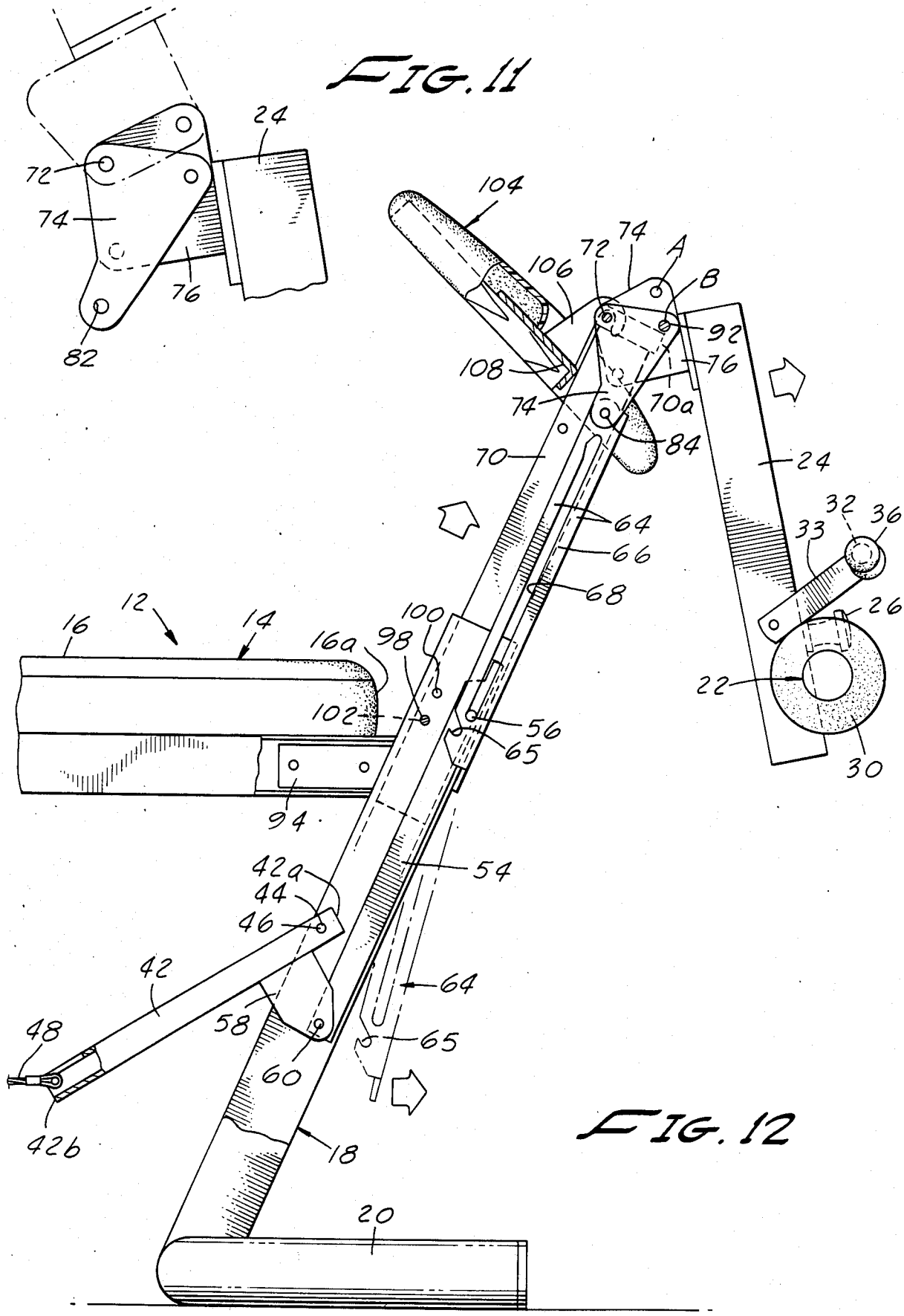
FIG. 11 is a fragmentary view of the positioning means of the apparatus illustrating the various arcuately spaced positions into which the body engaging means can be locked to enable the performance of various arm and leg exercises.
FIG. 12 is a side elevational view, similar to Figure 10, but showing the position of the component parts of the apparatus when the apparatus is configured for the accomplishment of arm curl type exercises.

Referring particularly to FIGS. 5 and 12, slidably carried within leg members or standards 18, are first and second support members 70. As indicated in FIG. 12, members 70 are slidably movable within standards 18 from a first lowered position shown in FIG. 5 to a second raised position shown in FIG. 12. Associated with first and second support members 70, are connecting plate means for interconnecting the second automatically adjustable linkage and the body engaging means with the support members, whereby the body engaging means is arcuately movable between a first lowered position and a second elevated position. Because the body engaging means is interconnected with the support members by the connecting plate means, movement of the support members from the first lowered position to the second elevated position, shown in FIG. 12, will also result in movement of the body engaging means from a first lowered position, as shown in FIG. 3, to a second elevated position, as as shown in FIG. 12. Similarly, because the second automatically adjustable linkage is also interconnected with the support members, upward movement of the support members will also result in upward movement of member 64.

Turning to FIGS. 5 and 6, it can be seen that an axle 72 is connected to and extends between the top portions 70*a* of support members 70. The connecting plate means, which in the present form of the invention is provided in the form of a pair of spaced apart connector plates 74 having axle receiving apertures 73, are carried by axle 72 for rotational movement with respect to support members 70. To permit interconnection of the body engaging means with axle 72, third planar member, or apertured connecting element 76, is connected to the upper end of structural member 24 and is provided with a bearing assembly 78 adapted to receive axle 72.

Provided proximate the lower extremity of plates 74, are apertures 82 which are adapted to receive another axle member 84. As best seen in FIG. 6, side walls 66 of member 64 of the second linkage are apertured proximate their upper ends at 86 to receive axle 84, thereby permitting interconnection of plates 74 with the second member 64 of the linkage means of the invention.

With the construction described in the preceding paragraphs, it is apparent that the body engaging means is pivotally movable relative to the support member 70 and also is movable upwardly relative to the exercise bench upon upward sliding movement of members 70 with respect to standards 18 (FIG. 12).

It is to be observed that the side walls 66 of member 64 are provided with hook-like slots 65 located proximate the lower extremity of the member. It is also to be observed that connector plates 74 are provided with apertures 90 which are alignable with an aperture "A" formed in the rearwardy extending planar member 76 of the body engaging means so as to permit the insertion of locking pin 92 through the aligned apertures (FIGS. 5 and 6).

Figure 10:
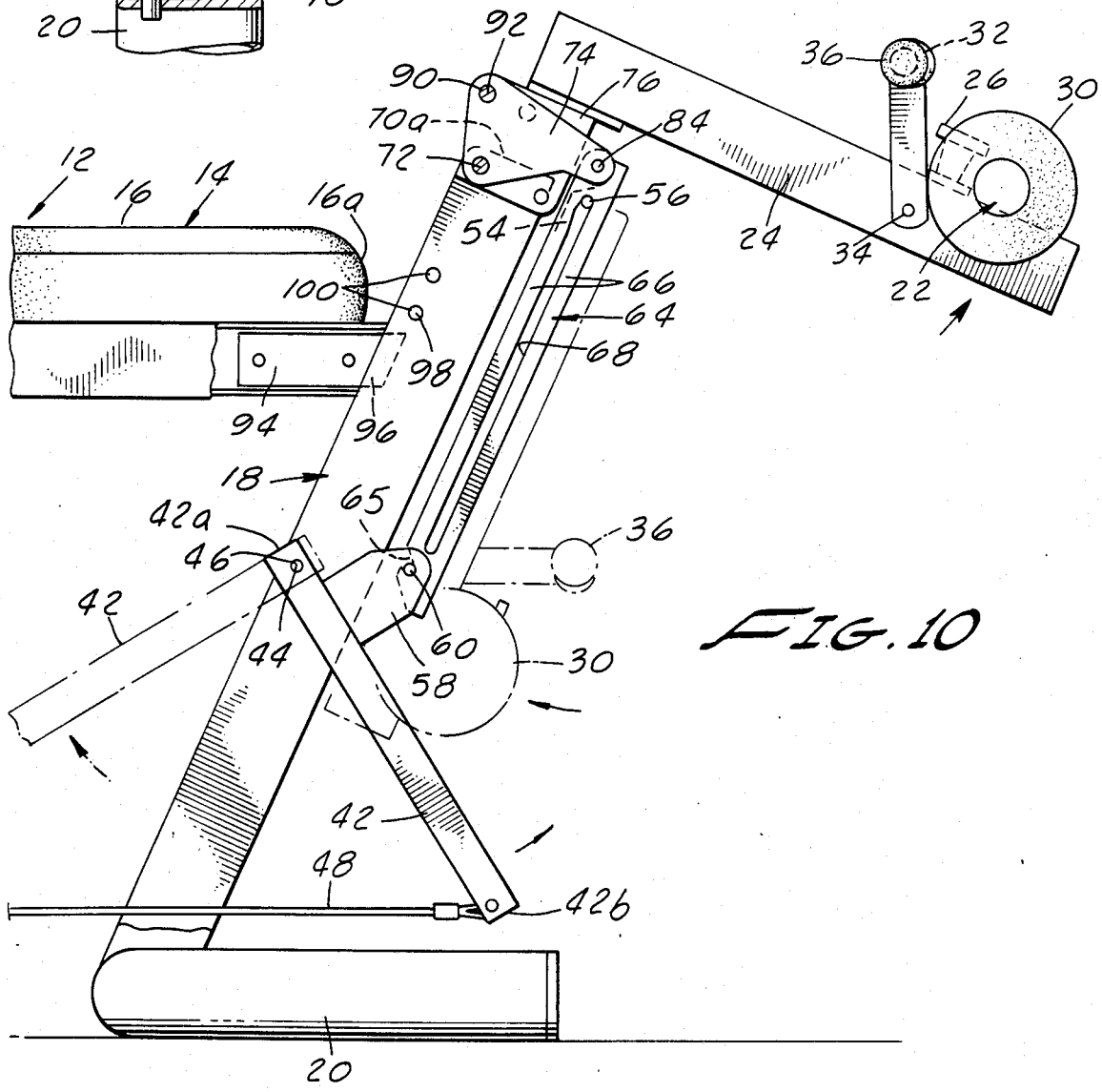
FIG. 10 is a side elevational view of the forward end of the apparatus, similar to that shown in FIG. 3, but illustrating the arrangement of the component parts of the apparatus when the apparatus is configured for the accomplishment of leg extension type exercises.

Referring now to FIGS. 3 and 10, the apparatus of the invention is thereshown configured for the performance of leg extension type exercises. In this configuration, the body engaging means is in its lowest most position relative to the floor and is also arcuately positioned at its closest point to legs 18. In this position, pin 92 is inserted through apertures 90 in plate 74 and through aperture "A" in plate 76 so as to interconnect the body engaging means with connector plates 74. It is important to note that in the configuration shown in FIGS. 3 and 10, the hook-like slots 65 in member 64 are in engagement with axle 60 of first linkage member 54.

Figure 4:
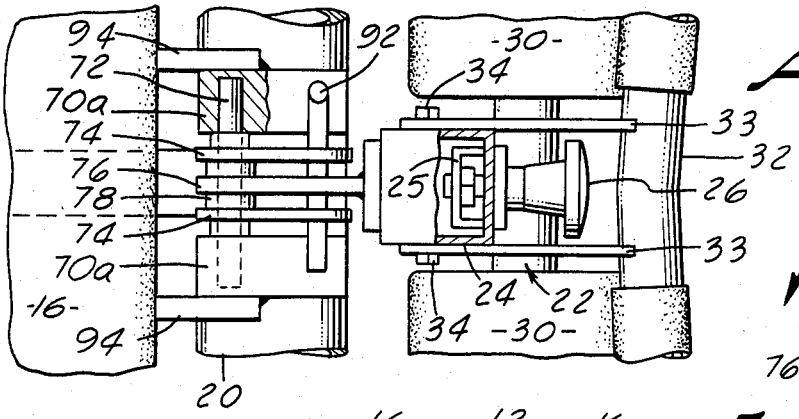
FIG. 4 is a fragmentary view partially in section taken along lines 4—4 of FIG. 3.

For the performance of leg extension exercises, the trainee seats himself proximate the forward end of bench 16*a* facing the body engaging means. The top of the trainee's feet are them placed in engagement with pads 30 of first body engaging member 22. It is to be noted that the forward end of bench 14 is maintained in an elevated position by means of a pair of connector plates 94 which are affixed to either side of the exercise bench and are interconnected at 96 with leg members 18 (FIG. 3 and 4). Upward movement of the trainee's legs will cause the body engaging means to pivot from the position shown in FIG. 3 to the position shown in FIG. 10. Because the body engaging means is interconnected with member 64 of the second linkage via the connector plates 74 and the axle 84 and because the lower end of second linkage member 64 is interconnected with first linkage 42 via the hook-like apertures 65 which are in engagement with axle 60, upward pivotal movement of the body engaging means will result in foward pivotal movement of member 42 about fixed axis 44 in the manner illustrated in FIG. 10. Forward movement of member 42 will exert a pulling force on cable 48 which, in turn, will cause the upward travel of one or more weights 38 with respect to guide column 40 thereby biasing against forward movement of first linkage 42 to a uniform pre-determinable extent. It is to be observed that during the performance of the leg extension exercise, upward relative movement of support members 70 relative to standards 18 is prevented by a locking pin 98 which is inserted into aligned apertures 100 provided in members 70 and 18 (FIGS. 3 and 5).

Figure 13:
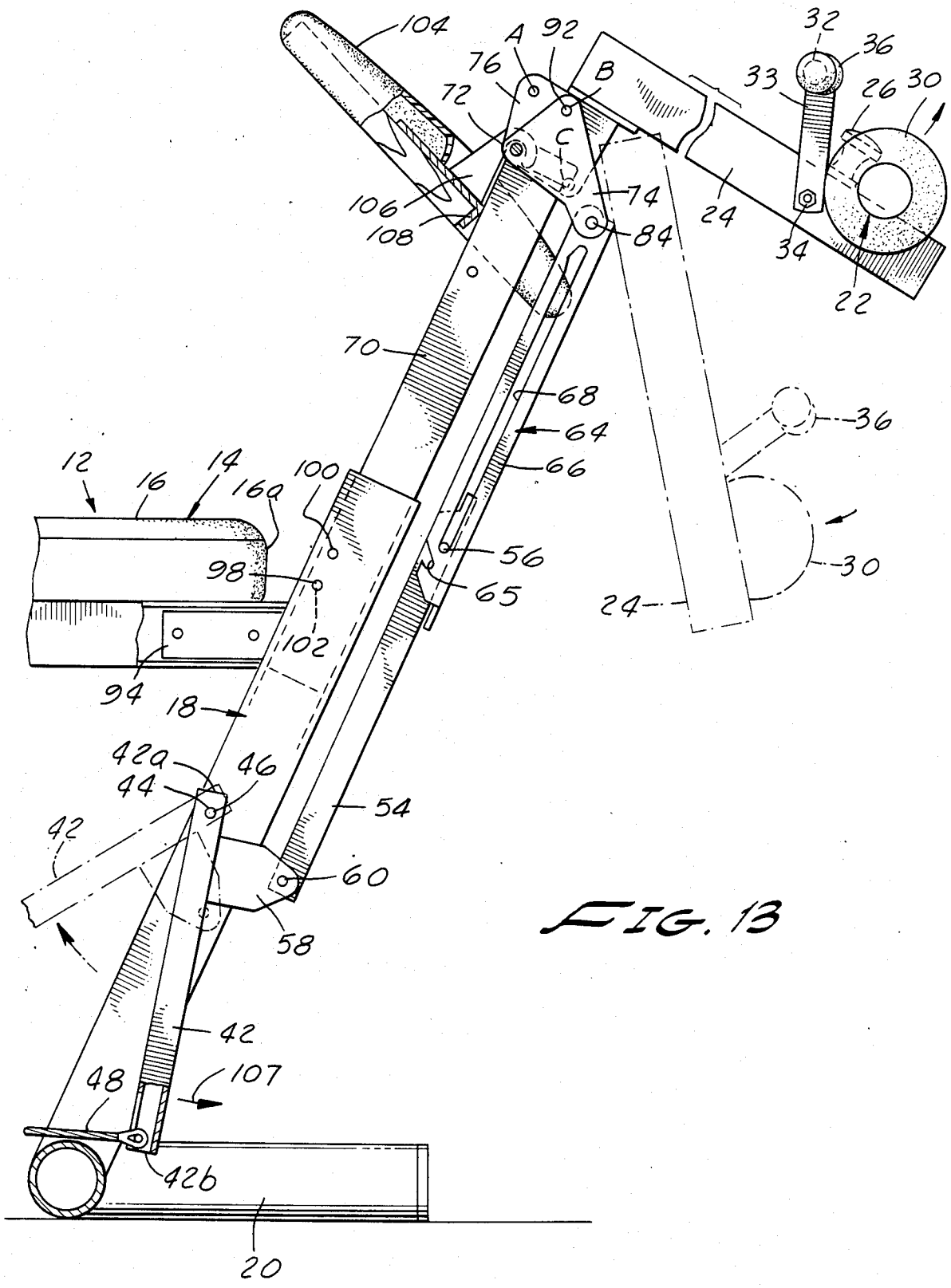
FIG. 13 is a side elevational view of the forward end of the apparatus of the invention similar to FIG. 12 but showing the degrees of movement of the component parts of the apparatus during the performance of arm curl type exercises.

Turning now to FIGS. 11, 12 and 13, the apparatus of the invention thereshown is configured for the performance of arm curl type exercises. In this configuration, the body engaging means has been raised to a second position above the floor and has also been arcuately positioned so as to define an acute angle with respect to upright standards 18. To adjust the apparatus from the configuration shown in FIG. 3 to the Configuration shown in FIG. 12, the following steps are required: First, locking pin 98 must be removed from apertures 100 and sliding supports 70 moved telescopically upward with respect to standards 18 to the position shown in FIG. 12. In this position, locking pin 98 may be reinserted into apertures 100 formed in standards 18, but in this instance will pass through apertures 102 formed in sliding members 70 (FIG. 5). It is to be observed that before attempting the upward sliding movement of member 70 relative to standard 18, it is necessary to move member 64 of the second linkage pivotally outwardly in the manner indicated by the phantom lines in FIG. 12 so as to disengage the hook-like apertures 85 from axle member 60. Only after disengagement of the hook-like member 65 can the assembly be moved into the configuration shown in FIG. 12 with member 64 of the second linkage extending upwardly with respect to member 54 of the second linkage. It is to be observed that in this uppermost position, guide pin 56 carried by member 54 has bottomed out in groove 68 provided in the side walls of member 64. Guide pin 56 thus serves three purposes. First, to guide the travel of element 64 with respect to element 54, second, to act as a stop, limiting the upward travel of member 64, and third, to interconnect members 64 and 54 so to a force urging upward movement of member 64 will also urge simultaneously upward movement of member 54 and thereby cause a forward pivotal movement of first linkage 42.

In addition to the body engaging means being elevated for the performance of arm curl exercises, it is to be noted that the body engaging means is locked in an angularly spaced position with respect to the upright standards 18. More particularly, in this configuration locking pin 92 has been removed from aperture "A" in plate 76 and has been reinserted through apertures 90 in connecting plate 74 and through aperture "B" which is provided in planar member 76. Pin 92, in this position, functions to rigidly secure the body engaging means in the angular starting orientation illustrated in FIG. 12.

Referring to FIG. 11, the degree of movement of planar member 76 with respect to connecting plates 74 is there illustrated. In the position designated by the solid lines in FIG. 11, it can be seen that the body engaging means in all instances pivots about axle member 72. However, member 76 can be positioned in various locations as indicated by the phantom lines of FIG. 11. In FIG. 11 the solid lines show the positioning of the body engaging means for performance of the arm curl. The phantom lines of FIG. 11 illustrate other possible positions of the body engaging means to enable the performance of other exercises in a manner presently to be discussed.

After the apparatus has been moved into the configuration shown in FIG. 12 with the body engaging means raised relative to bench 14, an upper arm support member 104 is affixed to the apparatus by placing the spaced apart hook-like members 106 provided on member 104 over pivot axle 72. Support 104 is also constructed to include right angle members 108 which are adapted to engage members 70 so as to maintain member 104 in the angular orientation shown in FIGS. 12.

For the performance of arm curl exercises, the trainee is seated on the forward end of the bench facing the body engaging means. The trainee then grips the second body engaging means 32 with his hands in a manner such that the tricep portions of trainee's upper arms are supported by member 104. When the trainee pulls upwardly on second body engaging means 32 so as to curl his arms upwardly, pivotal movement will, of course, be imparted to member 24 of the body engaging means. This upward pivotal movement is represented by the solid lines in FIG. 13. Referring to FIG. 13, it can be seen that the upward pivotal movement of member 24 has caused simultaneous upward pivotal movement of connector plates 74. Since these plates are interconnected by means of axle 84 with member 64 of the second linkage which in turn is interconnected to member 54 of the second linkage by means of guide pin 56, upward movement of the body engaging means will result in upward movement of the second linkage assemblage. This upward movement will result in a forward pivotal movement of first linkage member 42 in the direction of the arrow 107 of FIG. 13. As in the case of the previously described exercise, forward movement of member 42 will exert a force on cable 48 which will result in a lifting force being exerted on one or more of the weights 38. It is very important to note that the pulley force exerted on cable 48 is accomplished in an identical manner in the performance of the arm curl exercises and in the performance of the previously described leg extension exercises. More particularly, the forward pivotal movement of first linkage member 42 in all cases takes place about the fixed pivot axis 44 so that the force exerted on cable 48 and in turn on one or more weights, is comparable to the force exerted during the performance of the leg extension exercises. This duplicative exertion of the force on cable 48 is attributable to the novel construction and arrangement of the linkage means of the invention as illustrated in and described in the preceding paragraphs. This important feature of the invention is nowhere disclosed in the prior art and for the first time provides means for duplicating the forces resisting pivotal movement of the body engaging means during the performance of both arm curl and leg extension type exercises.

Figure 14:
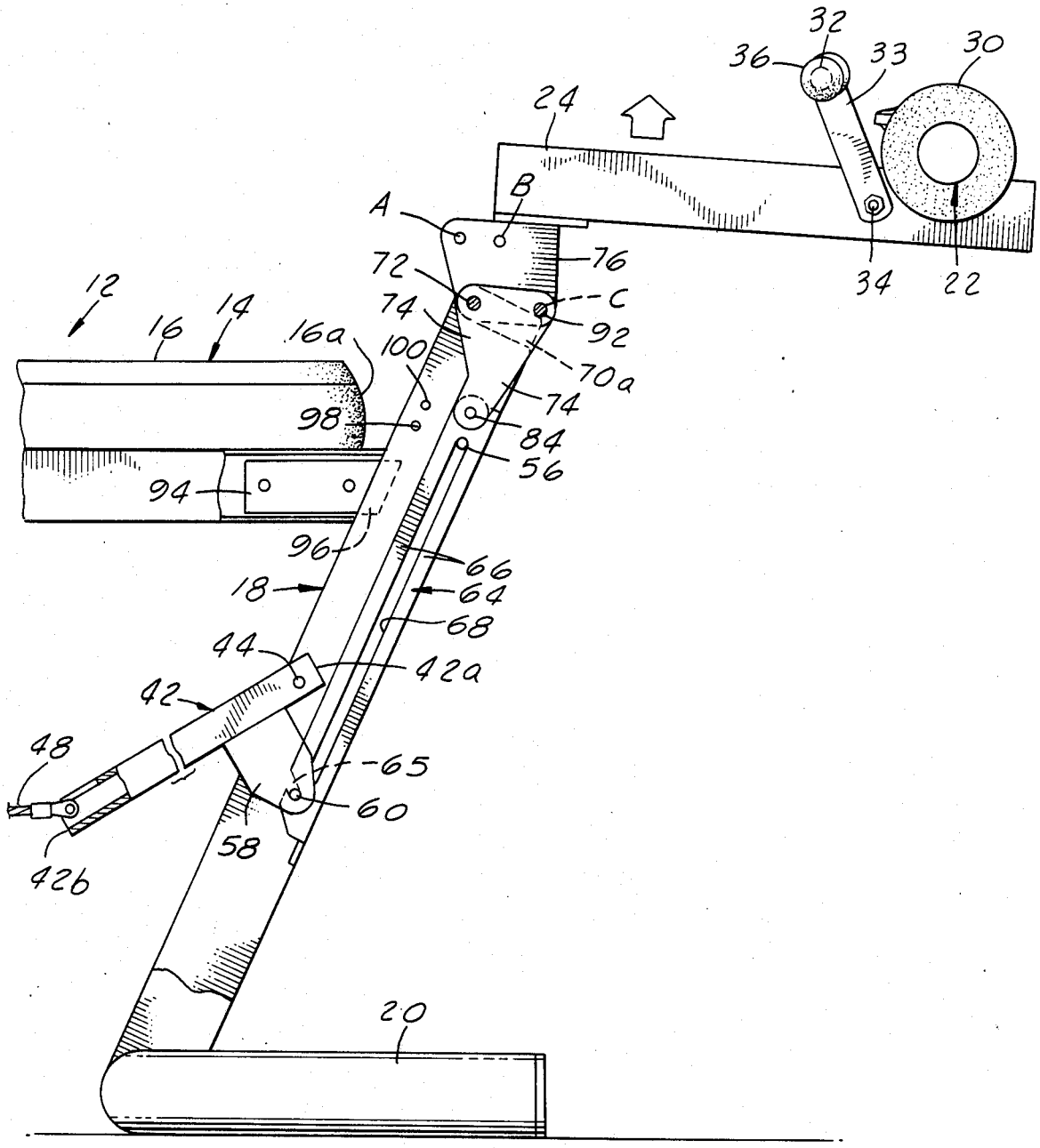
FIG. 14 is a side elevational view of the forward part of the apparatus, similar to FIGS. 10 and 12, but showing the position of the component parts of the apparatus when the apparatus is configured for the accomplishment of leg curl type exercises.
Figure 15:
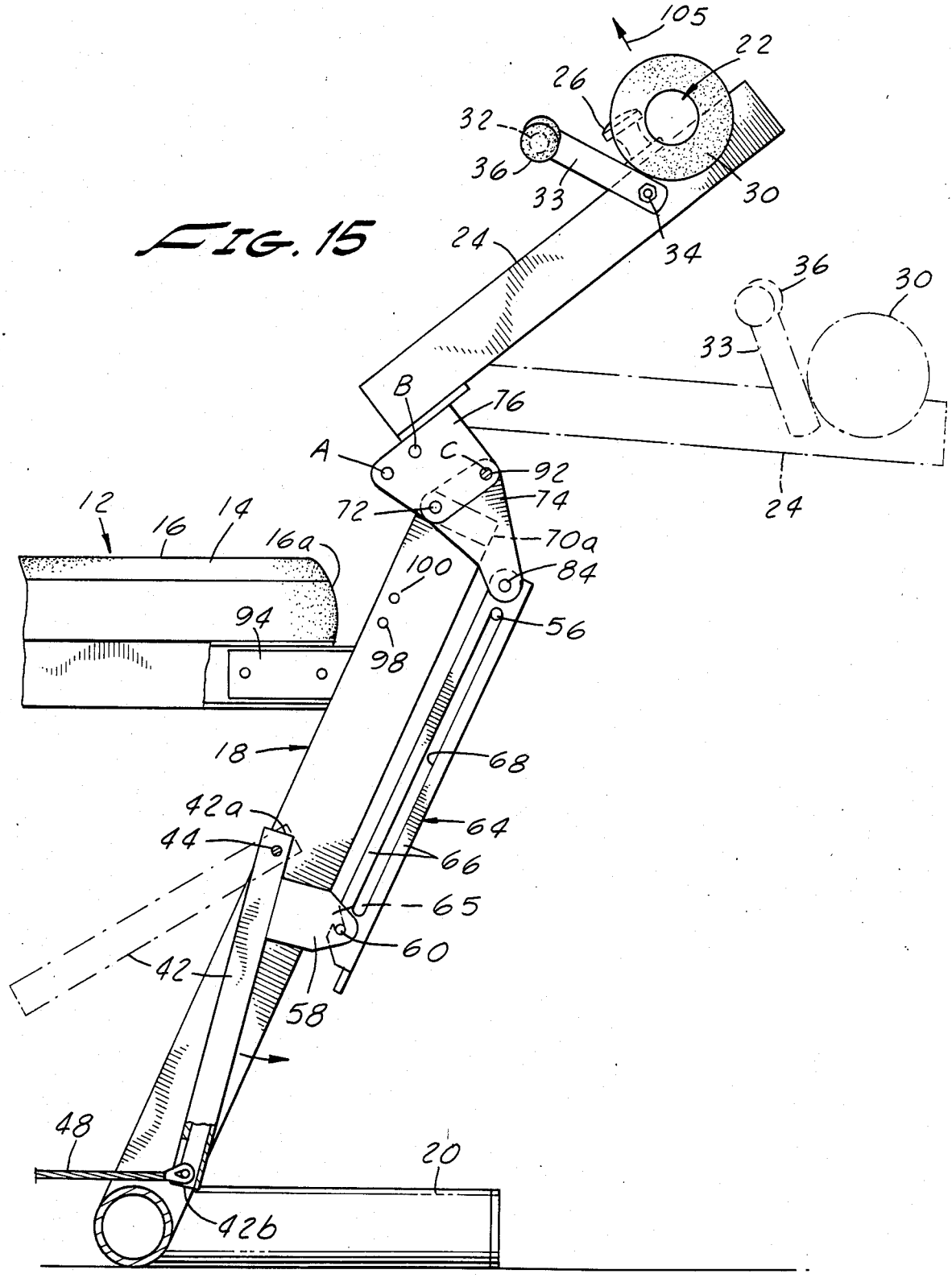
FIG. 15 is a side elevational view of the forward end of the apparatus, similar to FIG. 14, but showing the degrees of movement of the various component parts on the apparatus during the accomplishment of leg curl type exercises.

Referring now to FIGS. 14 and 15, the apparatus of the invention is thereshown configured for the performance of leg flexion or curl type exercises. In this configuration, the body engaging means has been returned to its lowest most position relative to the floor. However, the body engaging means has been arcuately positioned in a third starting position wherein it is generally parallel with the floor. This repositioning of the body engaging means has been accomplished by removal of locking pin 92 from the apertured connector plates 74 and the "B" aperture of planar member 76. To securely lock the body engaging means in the position illustrated in FIG. 14, it is necessary to raise the body engaging means to the position shown and reinsert locking pin 92 through the apertures in connecting plates 74 and through the aperture designated by the letter "C" in planar member 76. It is to be noted that with the apparatus in the configuration illustrated in FIG. 14, hook-like slots 65 provided in member 64 have once again been moved into engagement with axle 60 and locking pin 98 has been reinserted into aperture 100 formed in members 18 and 70. With this arrangement member 64 of the second linkage means is once again directly interconnected with first linkage member 42 so that upward movement of members 54 and 64 will result in forward pivotal movement of first linkage member 42 about pivot axis 44.

In the performance of leg curl exercises, the trainee is positioned face down on the bench with the back of the legs beneath and in engagement with pads 30 of the second body engaging means, or member, 22. Upon a bending, movement or curling of the legs by the trainee toward the rear of the bench, the body engaging means will be urged upwardly and rearwardly in the manner illustrated in FIG. 15 (see arrow 105). Because planar members 76 of the body engaging means is interconnected with connector plates 74 by means of locking pin 92, this upward pivotal movement of the body engaging means will result in a upward force being exerted on the second linkage assembly made up of members 54 and 64. Because member 64 is interconnected with linkage 42 via hook slots 65 being interengaged with axle 60, upward movement of the second linkage assembly will result in forward pivotal movement of first linkage member 42, once again about axis 44. This forward pivotal movement of member 42 will, of course, exert a forwardly directed force on cable 48 which will, in turn, result in a lifting force being exerted on one or more of the weights 38. Once again, it is to be observed that this duplicate force acting upon the weight stack is generated in exactly the same manner in the performance of the leg curl exercises as it was generated in the performance of arm curl and leg extension exercises. Stated another way, in each instance, pivotal movement of linkage member 42 is about the same identical fixed axis 44 even through the pivotal movement of the linkage member 42 is generated as a result of pivotal movement of the body engaging means which may be disposed in a multiplicity of vertical and arcuate starting positions. This feature ensures that a duplicative, constant uniform and predeterminable resistance force is always applied yieldably resisting pivotal movement of the body engaging means without regard for the exercise being performed on the position of the body engaging means with respect to the support bench.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An exercise apparatus for use by a trainee in the performance of various exercises, including arm and leg exercises, said apparatus comprising:

(a) support means for supporting the trainee in various exercising positions;

(b) first body engaging means disposed proximate said support means for engagement by the trainee in the performance of a first exercise to impart pivotal movement thereto about a pivot axis spaced a first distance from said support means, said body engaging means being movable relative to said support means from a first position to a second spaced position wherein said body engaging means is engageable by the trainee in the performance of a second exercise to impart pivotal movement thereto about a pivot axis spaced a second distance from said support means;

(c) resistance means operably associated with said body engaging means for providing a constant resistive force to resist pivotal movement of said body engaging means when said latter means is in either said first or second position; and (d) linkage means for operably interconnecting said resistance means with said body engaging means, said linkage means comprising:

(i) a first linkage adapted for pivotal movement about a fixed axis located a fixed distance from said support means, said first linkage being operably interconnected with said resistance means; and (ii) a second automatically adjustable linkage for operably interconnecting said body engaging means with said first linkage when said body engaging means is in either said first or second position, whereby pivotal movement of said body engaging means by the trainee will cause pivotal movement of said first linkage about said fixed axis, which pivotal movement will be uniformly resisted by said resistance means.

2. An exercise apparatus as defined in claim 1 in which said support means comprises and exercise bench having first and second ends and in which said apparatus further comprises:

(a) first and second spaced apart upwardly extending standards for supporting one end of said exercise bench;

(b) first and second support members slidably carried by said first and second standards for movement between a first position and a second position; and (c) connecting plate means for interconnecting said body engaging means with said first and second support members whereby said body engaging means is arcuately movable between a first lowered position and a second elevated position.

3. An exercise apparatus as defined in claim 2 in which said second linkage of said linkage means comprises:

(a) an elongated first member pivotally connected proximate one end to said first linkage of said linkage means and having proximate the other end a laterally extending guide element; and (b) an elongated second member having spaced apart side walls defining a guide channel there between for slidably receiving said first member, each of said side walls having an elongated slot formed thereby for slidably receiving said guide element of said first member, said second member being slidably movable relative to said first member upon movement of said first and second support members between said first and second positions.

4. An exercise apparatus as defined in claim 3 in which said elongated first member of said second linkage is pivotally connected to said first linkage by a laterally extending axle and in which said elongated second member of said second linkage is provided with hook means for releasably engaging said laterally extending axle when said first and second support members are in said first position.

5. An exercise apparatus as defined in claim 4 in which said body engaging means comprises first laterally extending members for engagement by the trainee in performing leg exercises and second laterally extending members for engagement by the trainee in performing arm exercises.

6. An exercise apparatus as defined in claim 5 including a connecting element mounted on said body engaging means for cooperative associated with said connecting plate means for positioning said body engaging means in a plurality of starting positions relative to said support means.

7. An exercise apparatus as defined in claim 6 in which said connecting plate means comprises spaced apart first and second planar members having a plurality of apertures therethrough and in which said connecting element comprises a third planar member disposed intermediate said first and second planar members and having a plurality of spaced apart apertures adapted to be moved into alignment with said apertures in said first and second planar members upon pivotal movement of said body engaging means, said positioning means further including a locking pin removably receivable within said aligned apertures in said first, second and third planar members whereby said body engaging means can be locked into a plurality of starting positions relative to said support means.

8. An exercise apparatus for use by a trainee in the performance of arm and leg exercises, comprising:

(a) an elevated bench including a trainee support surface having front and rear extremities and downwardly depending front leg members;

(b) at least one weight disposed proximate said rear extremity of said trainee support surface;

(c) first body engaging means disposed proximate said front leg members for engagement by the trainee, in the performance of a first exercise to impart pivotal movement thereto about a pivot axis spaced a first distance from said trainee support surface of said bench, said body engaging means being movable relative to said trainee support surface from a first lowered position to a second elevated position wherein said body engaging means is engageable by the trainee in the performance of a second exercise to impart pivotal movement thereto about a pivot axis spaced a second distance from said trainee support surface;

(d) a first linkage caried by said front leg members for pivotal movement about a fixed axis spaced apart from said trainee support surface, said first linkage having first and second extremities;

(e) an elongated connector connected proximate one end to said first extremity of said first linkage and connected proximate the other end to said weight whereby pivotal movement of said first linkage in a forwardly direction will impart a lifting force to said weight; and (f) a second automatically adjustable linkage for operably interconnecting said body engagine means with said first linkage when said body engaging means is in either said first lowered position or said second elevated position, whereby pivotal movement of said body engaging means by the trainee will cause pivotal movement of said first linkage in a forwardly direction about said fixed axis.

9. An exercise apparatus as defined in claim 8 in which said apparatus further comprises:

(a) first and second support members slidably carried by said front leg members for movement between a first lowered position and a second elevated position; and (b) connecting plate means for interconnecting said body engaging means with said first and second support members whereby said body engaging means is arcuately movable between a first lowered position and a second elevated position.

10. An exercise apparatus as defined in claim 9 in which said second linkage comprises:

(a) an elongated first member pivotally connected proximate one end to said first linkage intermediate said first and second extremities thereof and having proximate the other end a laterally extending guide element; and (b) an elongated second member having a guide channel for slidably receiving said first member, said second member being slidably movable relative to said first member upon movement of said first and second support members between said first and second positions.

11. An exercise apparatus as defined in claim 10 in which said elongated second member has spaced apart slotted side walls adapted to slidably receive said guide element of said first member and in which said elongated first member of said second linkage is pivotally connected to said first linkage by a laterally extending axle.

12. An exercise apparatus as defined in claim 11 in which said elongated second member of said second linkage is provided with means for releasably engaging said laterally extending axle when said first and second support members are in said first lowered position.

13. An exercise apparatus as defined in claim 12 including means carried by said first and second support members for positioning said body engaging means in a plurality of arcuately spaced starting positions.

14. An exercise apparatus for use by a trainee in the performance of arm and leg exercises, comprising:

(a) an elevated bench including a trainee support surface having a front and rear extremity and laterally spaced apart downwardly depending leg members;

(b) support members slidably carried by said laterally spaced apart leg members for movement between a first lowered position and a second elevated position;

(c) a first axle connected to said support members and extending therebetween;

(d) a pair of spaced apart, apertured connector plates carried by said first axle;

(e) at least one weight disposed proximate said rear extremity of said elevated bench;

(f) body engaging means including a connecting element adjusted to be connected to said first axle, said body engaging means being engageable by the trainee in the performance of leg exercises to impart pivotal movement thereto about a pivot axis spaced a first distance from said trainee support surface of said bench, said body engaging means being movable relative to said trainee support surface from a first position to a second position wherein said body engaging means is engageable by the trainee in the performance of arm curl exercises to impart pivotal movement thereto about a pivot axis spaced a second distance from said trainee support surface;

(g) a first linkage carried by said leg members for pivotal movement about a fixed axis spaced apart from said trainee support surface, said first linkage having first and second extremities;

(h) an elongated flexible cable connecter connected proximate one end to said first extremity of said first linkage and connected proximate the other end to said weight whereby pivotal movement of said first linkage in a forwardly direction will impart a lifting force to said weight; and (i) a second automatically adjustable linkage for operably interconnected said body engaging means with said first linkage when said body engaging means is in either said first lowered position or said second elevated position, whereby pivotal movement of said body engaging means by the trainee will cause pivotal movement of said first linkage in a forwardly direction about said fixed axis, said second automatically adjustable linkage comprising:

(i) an elongated first member having a laterally extending second axle disposed proximate a first end thereof, said second axle being pivotally connected to said first linkage intermediate said first and second extremities of said first linkage, said elongated first member having disposed proximate a second end thereof a laterally extending guide element;

(ii) an elongated second member having spaced apart side walls defining a guide channel for slidably receiving said first member, said side walls being provided with elongated slots adapted to closely receive said guide element of said first member, said second member being pivotally connected to said connector plates and being slidably movable relative to said first member upon movement of said first and second support members being said first and second positions, said elongated second member of said second linkage further having means for releasably engaging said laterally extending second axle of said first member when said first and second support members are in said first lowered position.

15. An exercise apparatus as defined in claim 14 in which said connecting plate means comprises spaced apart first and second planar members having a plurality of apertures therethrough and in which said connecting element comprises a third planar member disposed intermediate said first and second planar members and having a plurality of spaced apart apertures adapted to be moved into alignment with said apertures in said first and second planar members upon pivotal movement of said body engaging means, said positioning means further including a locking pin removably receivable with said aligned apertures in said first, second and third planar members whereby said body enaging means can be locked into a plurality of starting positions relative to said support means.

* * * * *